US007300276B2

(12) United States Patent
Sun

(10) Patent No.: US 7,300,276 B2
(45) Date of Patent: Nov. 27, 2007

(54) SAFETY CONTROL SWITCH FOR AN IGNITION DEVICE

(76) Inventor: Hui-Ming Sun, 616 Hawick Rd., Raleigh, NC (US) 27615

( * ) Notice: Subject to any disclaimer, the term of this patent is extended or adjusted under 35 U.S.C. 154(b) by 0 days.

(21) Appl. No.: 10/907,465

(22) Filed: Apr. 1, 2005

(65) Prior Publication Data

US 2006/0223017 A1 Oct. 5, 2006

(51) Int. Cl.
*F23Q 11/36* (2006.01)
*F23Q 7/12* (2006.01)
*F23Q 2/16* (2006.01)

(52) U.S. Cl. ..... 431/153; 431/255; 431/344

(58) Field of Classification Search ..... 431/153, 431/255, 344; 292/DIG. 37, DIG. 30
See application file for complete search history.

(56) References Cited

U.S. PATENT DOCUMENTS 4,179,143 A * 12/1979 Shy ..... 292/179
5,412,179 A 5/1995 Chen ..... 219/262
5,496,169 A 3/1996 Chen ..... 431/153
7,044,509 B2 * 5/2006 Radel ..... 292/91

* cited by examiner

*Primary Examiner*—Carl D. Price
(74) *Attorney, Agent, or Firm*—Allan Chan; Allan Chan & Associates

(57) ABSTRACT

A safety control switch comprises a slide base movably mounted on the housing of a gas-fired ignition device, a push button positioned in a through hole of the slide base, a brake block fixed to the push button for inserting into a space between the slide base and the housing, and a locking piece movably mounted on the slide base and engaged with the through hole of the slide base, the locking piece being moved relative to the slide base between a first position to prevent the push button and the slide base from being operated by blocking the through hole and a second position to allow the push button and the slide base to be operated by removing the blockage of the through hole.

10 Claims, 6 Drawing Sheets

Switch Assembly, cross-section

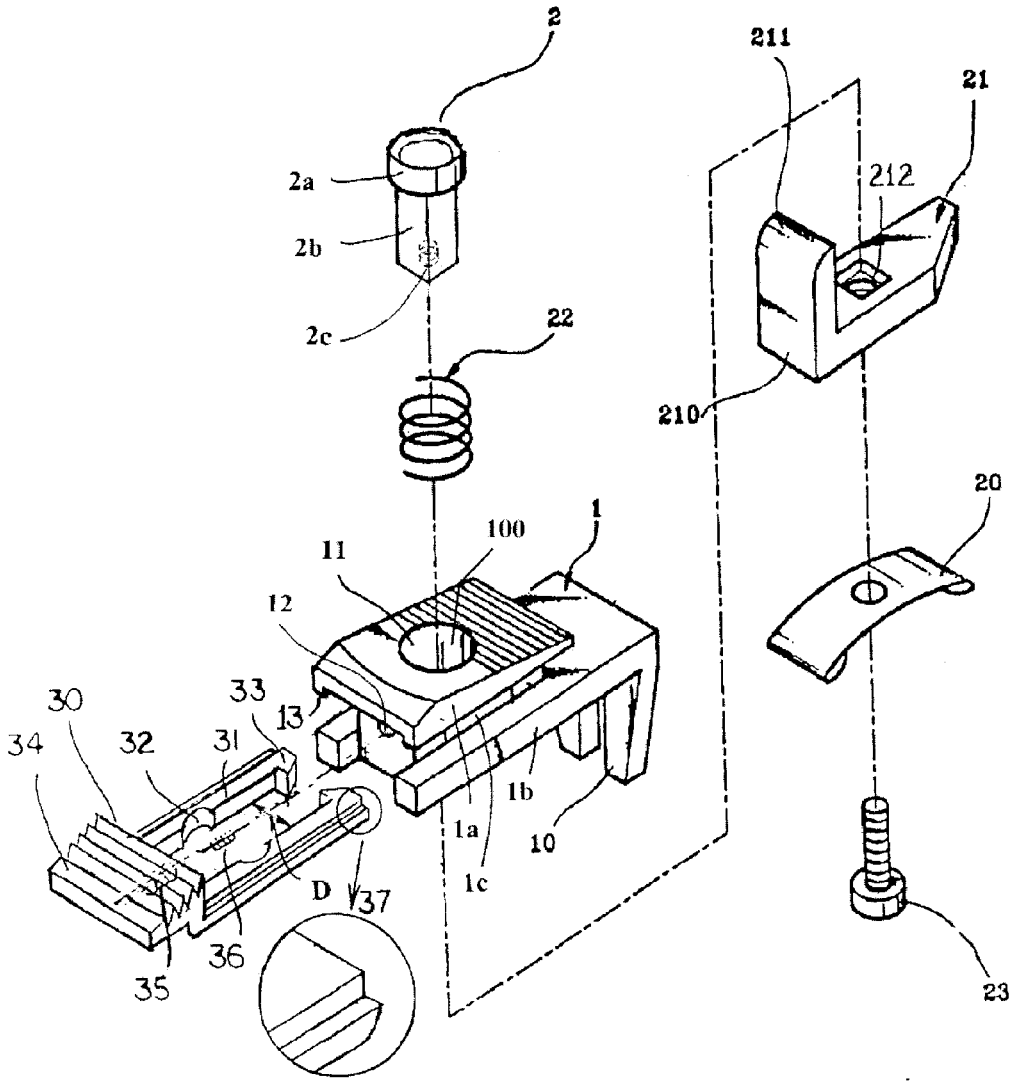
Fig. 1 Switch Assembly

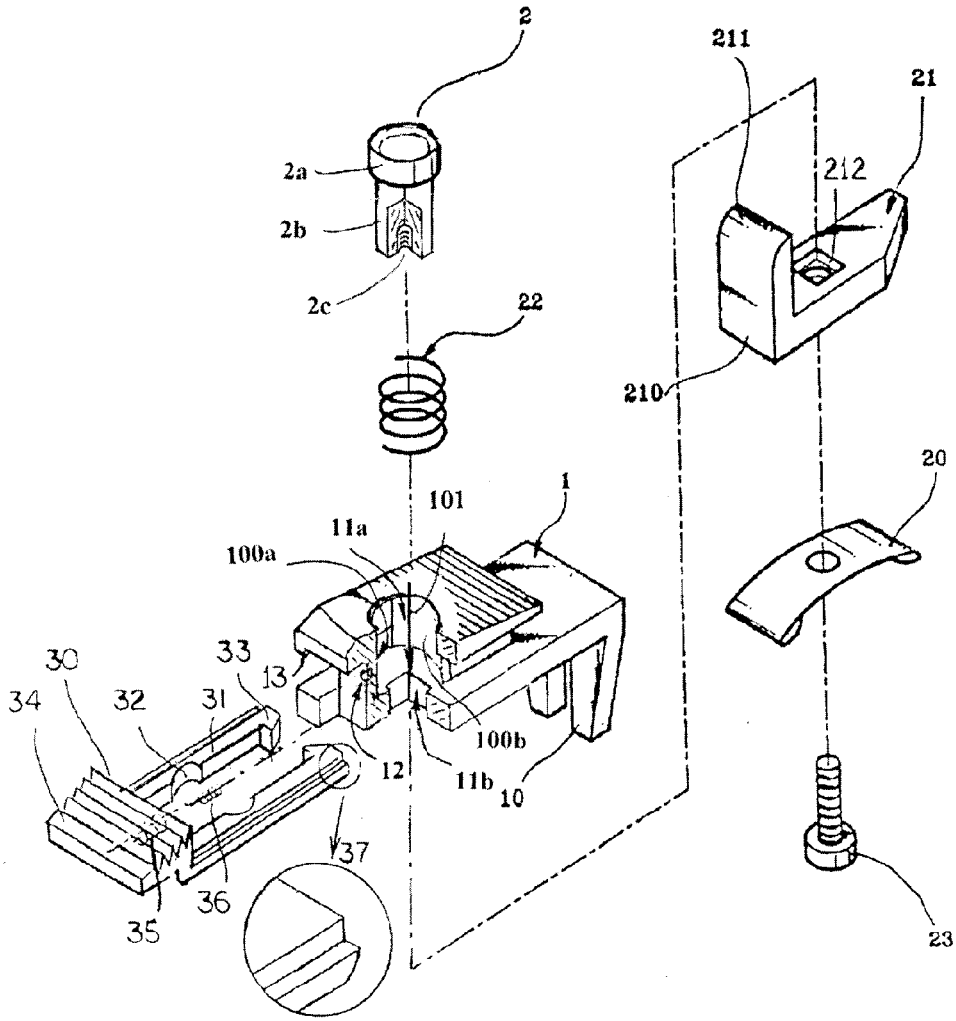
Fig. 2 Switch Assembly, cross-section

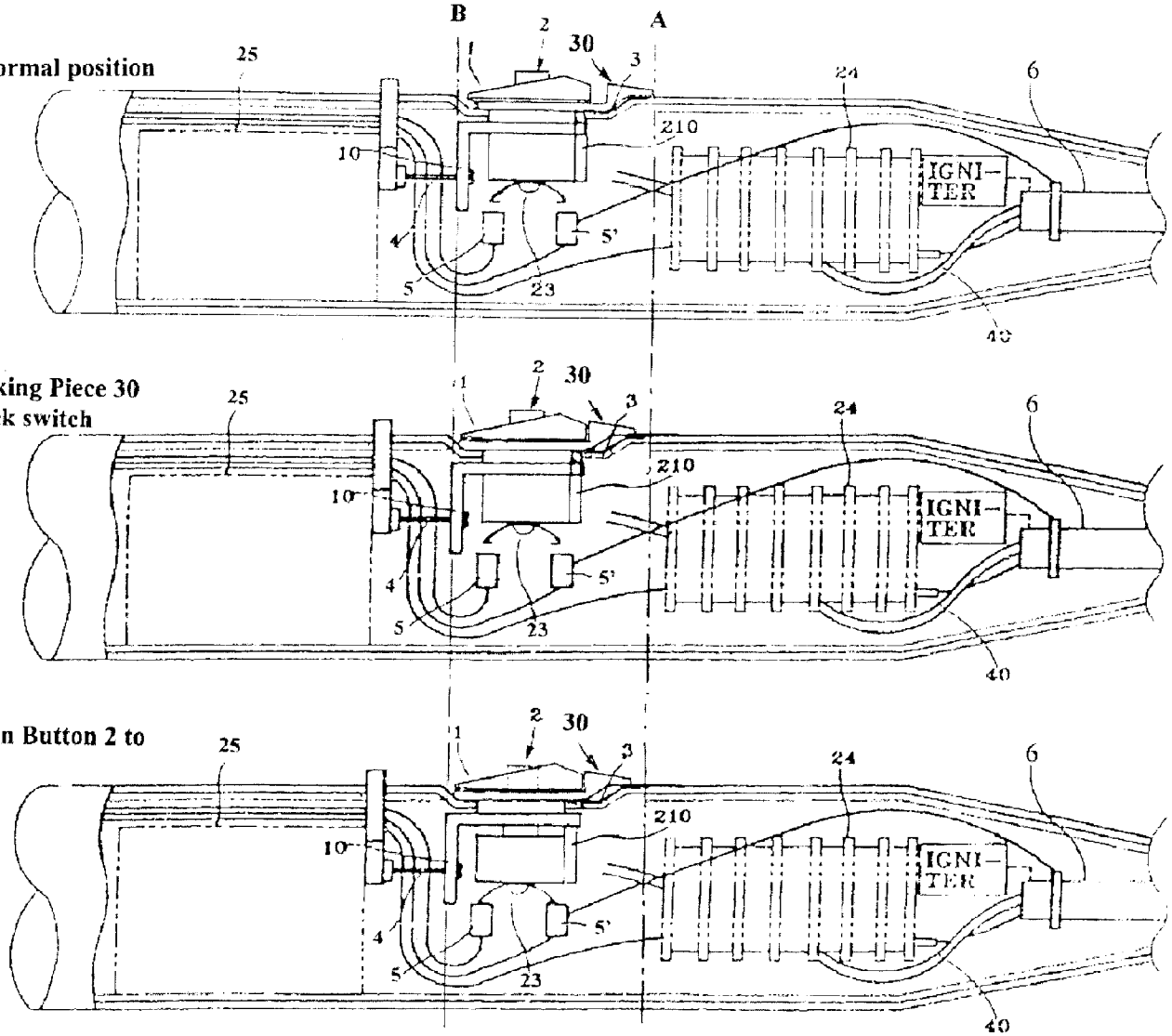
Fig. 3a Initial/normal position
Fig. 3b Pull Locking Piece 30 backward to unlock switch
Fig. 3c Push down Button 2 to generate sparks

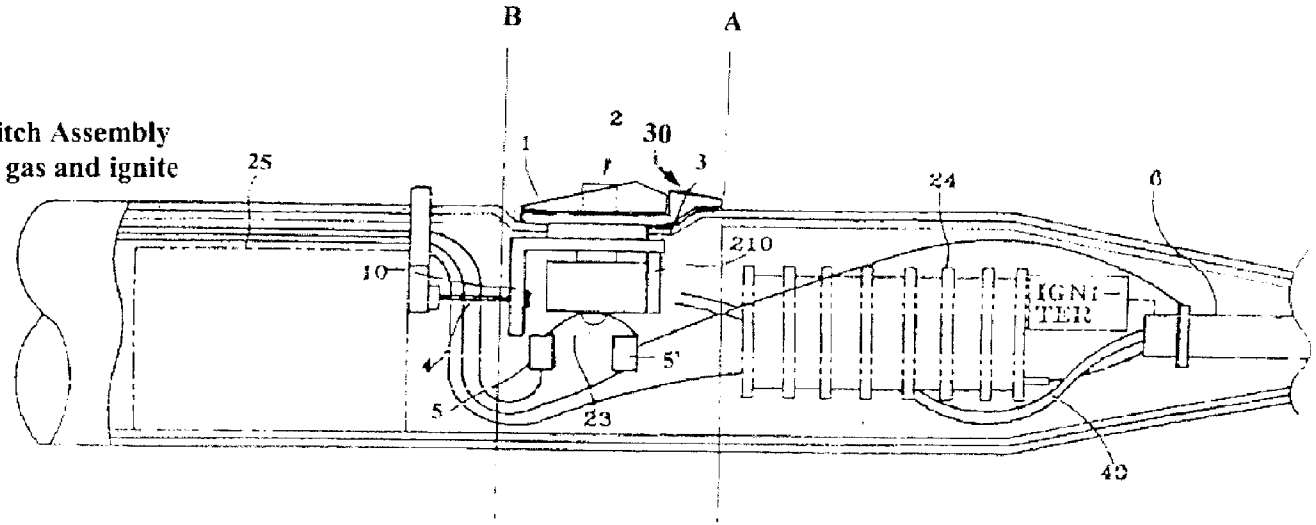
Fig. 3d Push Switch Assembly forward to release gas and ignite flame
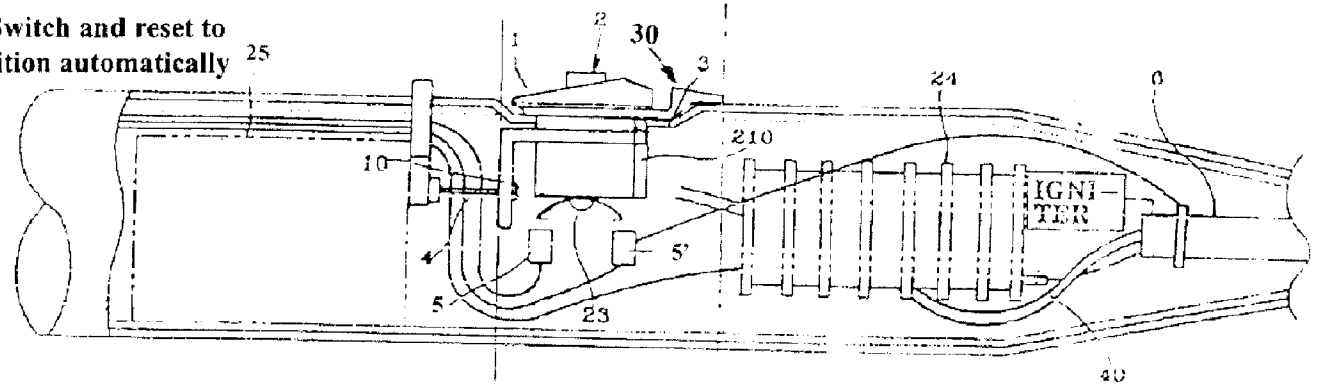
Fig. 3e Release Switch and reset to initial locking position automatically

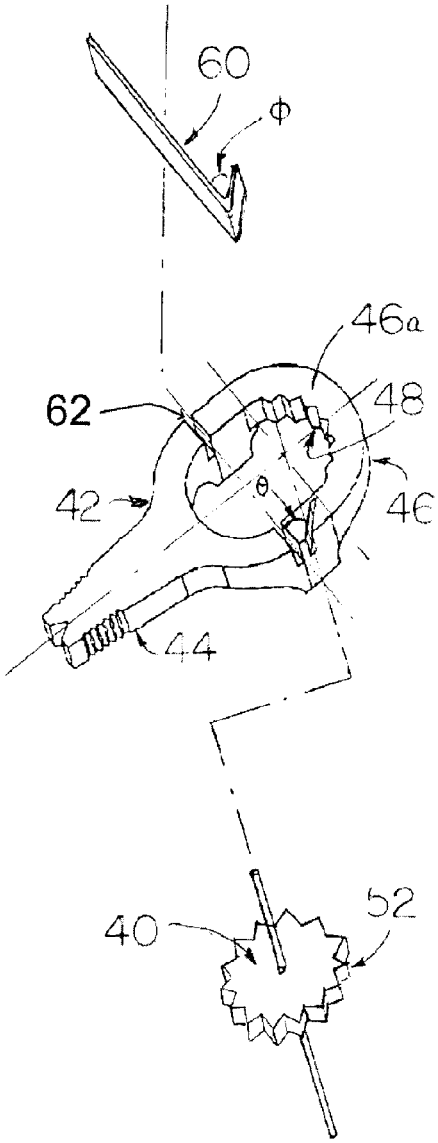
Fig. 4 Valve Handle Assembly
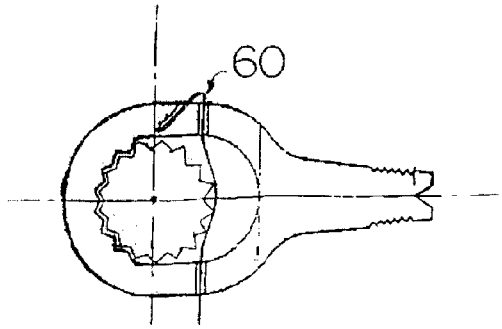
Fig. 5a Normal position, gas valve disk and handle are engaged
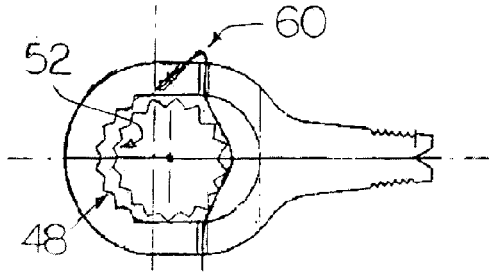
Fig. 5b Valve handle is pressed to disengage gas valve disk
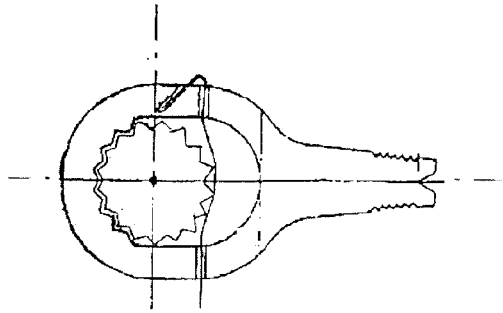
Fig. 5c Release handle to return to normal position, gas valve disk and handle are engaged

SAFETY CONTROL SWITCH FOR AN IGNITION DEVICE

BACKGROUND OF THE INVENTION

The present invention relates to a safety control switch for an electronic igniter operated flame ignition type ignition device, which can be operated to produce sparks as well as to make a flame, and a method for operating a safety control switch. The safety control switch has a locking device for locking the ignition switch from operation.

Various ignition devices are known and used for igniting a flame. Safety has always been a concern when operating an ignition device. U.S. Pat. No. 5,412,179 teaches the use of a push button ignition switch for controlling the operation of an ignition device for producing sparks and flame. The structure of the push button switch is functional, however, it has a drawback. Because the push button ignition switch is not locked when the ignition device is not in use, the push button ignition switch may be triggered by an error. That raises the safety concern, especially when the ignition device is accessible to children. U.S. Pat. No. 5,496,169, realizing the safety problem, teaches a safety control ignition switch for a gas-fired ignition device. A locking device is mounted on the housing of the gas-fired ignition device and moved relative to the push button ignition switch between a first (locking) position to stop the push button ignition switch from operation and a second (unlocking) position to let the push button ignition switch be operated. However, as the locking device is operated separately from the push button ignition switch, it is still possible that the locking device is left at the unlocking position when the ignition device is not in use and, therefore, the push button ignition switch may be triggered by accident, causing safety problems.

The contents of U.S. Pat. No. 5,412,179 and U.S. Pat. No. 5,496,169 are incorporated hereby in their entirety by reference.

SUMMARY OF THE INVENTION

The present invention has been accomplished to provide a safety control switch which eliminates the aforesaid problems by incorporating a blocking piece into the safety control switch. Three operational steps or movements are needed to make a flame using the safety control switch of the present invention, that greatly reduces the danger of accidentally firing a flame.

In another aspect of the present invention, a method of operating a safety control switch for a gas-fired ignition device is provided. The method comprises the steps of pulling back a locking piece to move it from an original position to a predetermined position; while holding the locking piece at the predetermined position, pressing down a push button of the safety control switch to produce sparks; and while pressing down the push button, moving a slide base of the safety control switch forward to release fuel gas to make a flame. The locking piece automatically returns to the original position when external force acting thereon the safety control switch is released.

In still another aspect of the present invention, a gas-fired ignition device having a special valve handle of a valve for adjusting the volume of gas flow from a fuel tank of the gas-fired ignition device is provided. The valve handle is coupled with the valve of the fuel tank and movable relative to the valve between a first position to engage with the valve and a second position to disengage with the valve.

BRIEF DESCRIPTION OF THE DRAWINGS

FIG. 1 is an exploded view of an ignition switch according to an embodiment of the present invention.

FIG. 2 is a sectional view of an ignition switch according to an embodiment of the present invention.

FIG. 3*a* through FIG. 3*e* are sectional view showing the ignition switch installed in a flame ignition type ignition device and a step-by-step movement of a normal switched-on operation cycle.

FIG. 4 is an exploded view of a valve handle assembly.

FIG. 5*a* through FIG. 5*c* show a step-by-step operation of the valve handle.

DETAILED DESCRIPTION OF THE PREFERRED EMBODIMENT

Figure 6A:
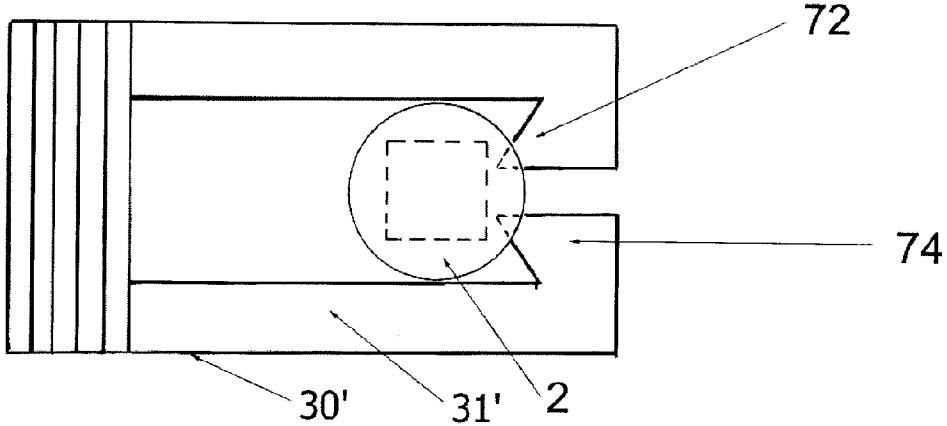
FIG. 6*a* is a top view of a locking piece according to another embodiment of the present invention.

According to one aspect of the present invention, a safety control switch for a gas-fired ignition device is provided. The safety control switch comprises a slide base having a through hole movably mounted in a track of a housing of a gas-fired ignition device, a push button movable in the through hole of the slide base, and a brake block fixed to and moving with the push button. The brake block is to be inserted into the track to fill the space between a front sidewall of the slide base and a front edge of the track. When the brake block is in the inserted position, the slide base is prevented from being moved forward relative to the housing. Only after the brake block is released or disengaged from the track, can the slide base be moved forward toward the front edge of the track.

The safety control switch further comprises a locking piece mounted on the slide base and engaged with the through hole of the slide base by partially extruding into the through hole. The locking piece and the slide base are so designed and assembled that the dimension, shape, or size of the cross-sectional area of the through hole can be changed at a predetermined location by moving the locking piece relative to the slide base. For example, the locking piece is moved relative to the slide base between a first position, where the dimension of the cross-sectional area of the through hole is reduced so as to prevent the push button from being pushed down, and a second position, where the dimension of the cross-sectional area of the through hole is not reduced so as to allow the push button to be fully pushed down.

In one embodiment, the locking piece comprises two legs partially intruding into the through hole of the slide base in a direction substantially perpendicular to the axis of the through hole. The two legs may have a varying width along its longitudinal direction. Therefore, when moving the two legs across the through hole, the dimension of the cross-sectional area of the through hole at the location intruded by the legs will change with the movement (at this location, the dimension of the cross-sectional area of the through hole is defined by the side wall of the through hole and the legs).

The leg of the locking piece can be provided with a recess which conforms to the dimension of the cross-sectional area of the through hole or to the dimension of outer circumference of the push button, so that when the locking piece is moved to a position where the recess aligns with the through hole, the push button is allowed to be pressed down to electrically connect an ignition circuit of the gas-fired ignition device to produce sparks and, at the same time, to disengage the brake block from the track.

Referring to FIGS. 1 and 2, a safety control ignition switch for a gas-fired ignition device in accordance with the present invention comprises a slide base 1 mounted in a track 3 on the housing of a gas-fired ignition device (FIGS. 3*a*-3*e*). When slide base 1 is moved forward in the track 3 to a predetermined distance, a gas nozzle 4 of a fuel tank 25 of the gas-fired ignition device is driven by slide base 1 to release a flow of fuel gas from fuel tank 25 to a flame nozzle (not shown) through a gas pipe 40. Gas nozzle 4 can be connected to slide base 1 in various conventional ways known in the art.

Slide base 1 has an upper body 1*a* and a lower body 1*b* separated by a middle portion 1*c*. In the embodiment shown in FIG. 1, the lower body 1*b* comprises a forked tail 10 extending into the housing of the gas-fired ignition device and connected to gas nozzle 4 when assembled. There is a through hole 11*a* in the upper body 1*a* and there is a through hole 11*b* in the lower body 1*b*, as shown in FIG. 2. Through hole 11*a* and through hole 11*b* are aligned to form a through hole 11 penetrating through slide base 1 for accommodating a push button 2. Push button 2 has an upper portion 2*a* and a lower portion 2*b* with the upper portion 2*a* being accepted by through hole 11*a* and the lower portion 2*b* being accepted by through hole 11*b*. Push button 2 is supported on a compression spring 22 within through hole 11 of slide base 1. One end of compression spring 22 is placed against the upper surface of the lower body 1*b* and the other end of compression spring 22 is placed against the lower surface of portion 2*a* of the push button 2.

The bottom end of push button 2 extends out of through hole 11 and is screwed up with a screw 23 to hold a conductive contact plate 20, such as a metal spring plate, and a brake block 21 against the lower body 1*b* of slide base 1. There is a threaded hole 2*c* at the bottom end of push button 2 for receiving the screw 23. Brake block 21 is retained between the conductive contact plate 20 and the lower body 1*b*. Brake block 21 has a through hole 212. Through hole 212 has an upper portion for receiving the bottom end of push button 2 and a lower portion for receiving screw 23. In the embodiment shown in FIG. 1, the dimension of the bottom end of push button 2 is larger than the dimension of the lower portion of through hole 212, so that the bottom end of push button 2 cannot extend into the lower portion of through hole 212. When assembled, the bottom end of push button 2 is inserted into the upper portion of through hole 212 of brake block 21, screw 23 is inserted through a hole of conductive contact plate 20 and into the lower portion of through hole 212 of brake block 21 to engage with the threaded hole 2*c* of push button 2. In this way, both the brake block 21 and the conductive contact plate 20 are fixed onto and move with the push button 2. When the push button 2 is not depressed, it is forced upwards to the upper limit position by the compression spring 22 (see the real line in FIG. 3*a*), and the conductive contact plate 20 is separated from contacts 5 and 5' at the two opposite terminals of the ignition circuit of the gas-fired ignition device. At the same time, an upright stop rod 210 of brake block 21 is inserted into the track 3 to fill the space between slide base 1 and the edge of track 3 so as to stop the slide base 1 from moving forward. When push button 2 is depressed, conductive contact plate 20 is brought into contact with contacts 5 and 5' and a high-tension winding 24 of the gas-fired ignition device is triggered to produce sparks for ignition and, at the same time, stop rod 210 of brake block 21 (which is fixed to and moves with push button 2) is moved downward and released from track 3 (see the imaginary line in FIG. 3*c*). Therefore, slide base 1 can be moved forward to pull gas nozzle 4 of the fuel tank 25 so as to release fuel gas for burning by the sparks (see also FIG. 3*d*). In this way, the safety control switch can be controlled to produce sparks as well as to produce a flame. It is clear, pushing down push button 2 without forward moving slide base 1 will generate sparks only. Furthermore, stop rod 210 may have a smoothly curved upper portion 211 with gradually reduced dimension upwards, which will help the slice base 1 to return to its original position when push button 2 is released.

The safety control ignition switch of the present invention further comprises a locking piece to engage with the slide base 1. When placed in a locking position, the locking piece at least partially blocks the through hole 11 of slide base 1 so that the upper portion 2*a* of push button 2 cannot move downward into the blocked portion of through hole 11. Therefore, push button 2 is prevented from being depressed. When in use, the locking piece is moved to an unlocking position and, at such position, it does not block through hole 11. When the gas-fired ignition device is not in use, the locking piece automatically returns back to the locking position, or otherwise is moved back to the locking position.

As an example, FIG. 1 shows a locking piece 30. Locking piece 30 comprises two legs 31 separated by a distance D. The distance D is smaller than the diameter of upper portion 2*a* of push button 2 (if the upper portion 2*a* is in a cylindrical shape or a disk shape as shown in FIG. 1), or smaller than the traverse dimension of upper portion 2*a* of push button 2 (if the upper portion 2*a* is not in a disk or cylindrical shape). Each leg 31 has a recess 32 facing each other. The area defined between the two recesses 32 is equal to or larger than the corresponding cross area of the upper portion 2*a* of push button 2 so that the upper portion 2*a* can pass through the gap between the two legs 31 at the location of the recesses 32, while cannot pass through the gap between the two legs 31 at other locations other than the recesses 32. In other words, in order to pass through the gap between the two legs 31, the upper portion 2*a* must be aligned with the recesses 32. When assembled, two legs 31 are inserted onto slide base 1 at the middle portion 1*c* and movable relative to the slide base 1. At one end of locking piece 30 is a handling block 34 for easy handling by hand, such as by thumb, when pulling the locking piece backwards relative to the slide base 1. Handling block 34 can be made any suitable shape. In the embodiment shown in FIG. 1, handling block 34 has an inclined upper surface with grooves. Handling block 34 has a hole 35 for receiving a compression spring 36. The other end of locking piece 30 is an open end so that locking piece 30 can be easily inserted onto the middle portion 1*c* of slide base 1. To prevent locking piece 30 from falling off the slide base 1, a hook 33 is formed at the end of each leg 31. Along the upper outer edge of each of the two legs 31 is a grove 37.

Further referring to FIGS. 1 and 2, at the middle portion 1*c* of slide base 1, a passage 101 is defined by a sidewall 100 of the middle portion 1*c* and the two legs 31 of locking piece 30. The passage 101 connects and is aligned with through hole 11*a* and through hole 11*b*, forming the through hole 11. The cross-sectional area of passage 101 is adjustable by moving locking piece 30 relative to side base 1. Thus, when the recesses 32 on legs 31 are aligned with through hole 11*a* by moving locking piece 30 to a predetermined position, the cross-sectional area of passage 101 becomes equal to or larger than the cross-sectional area of the upper portion 2*a* of push button 2 so that the upper portion 2*a* can be pushed down into passage 101, that causes conductive contact plate 20 to come into contact with contacts 5 and 5', that also causes stop rod 210 of brake block 21 to be disengaged from track 3 (as shown in FIG. 3*c*), so that slide base 1 is free to be moved forward to pull gas nozzle 4 of fuel tank 25 (as shown in FIG. 3*d*). On the other hand, if the recesses 32 are not aligned with through hole 11*a* (which is set to be the default position of locking piece 30 in the embodiment as shown), the cross-sectional area of passage 101 is smaller than the cross-sectional area of the upper portion 2*a* of push button 2 or, otherwise, does not conform to the shape of the cross-sectional area of the upper portion 2*a*, so that the upper portion 2*a* cannot fit into passage 101. As a result, the safety control ignition switch is prevented from operating. As an example, the side wall 100 shown in FIG. 2 comprises two parts, side wall 100*a* and side wall 100*b* with the inner surface of side wall 100*a* and the inner surface of side wall 100*b* facing each other and defining a space that is large enough to accept the upper portion 2*a* of push button 2. In the embodiment shown in FIGS. 1 and 2, the upper portion 2*a* has a disk shape, the inner surfaces of sidewall 100*a* and 100*b* have a partial cylindrical shape with a diameter equal to or slightly larger than the diameter of the upper portion 2*a*. In the embodiment shown in FIG. 1, the recesses 32 of locking piece 30 also have a partial cylindrical shape with a diameter substantially equal to that of the inner surface of sidewalls 100*a* and 100*b*.

As shown in FIGS. 1 and 2, on the lower surface of upper portion 1*a* of slide base 1, an extrusion edge 13 is formed along each edge for engaging with grove 37 of locking piece 30. When assembled, extrusion edge 13 fits into grove 37 so as to prevent two legs 31 from moving away from each other.

When assembled, locking piece 30 is inserted onto middle portion 1*c* of slide base 1 with sidewall 100 being positioned between two legs 31. Track 3 of the housing of the gas-fired ignition device is inserted between the lower surface of locking piece 30 and the upper surface of lower portion 1*b* of slide base 1. Locking piece 30 may further comprise a releasing mechanism so that whenever locking piece 30 is not operated by a user, it will be automatically returned to its default position, e.g., a locking position. In the embodiment shown in FIG. 1, handling block 34 has a hole 35 on its surface facing the slide base 1. On the outer surface of sidewall 100*a* facing hole 35 of the handling block 34, there is a recess 12. A compression spring 36 is placed in hole 35 of locking piece 30 at one end and received by recess 12 of slide base 1 at the other end, as shown in FIGS. 1 and 2. Therefore, when there is no external force acting on locking piece 30, the compression spring 36 helps to keep locking piece 30 in its predetermined default position by an elastic force. Also due to the compression spring 36, after locking piece 30 is moved to an unlocking position by an external force (such as a user's hand) and the external force is released, locking piece 30 will automatically return to its default position.

Figure 6B:
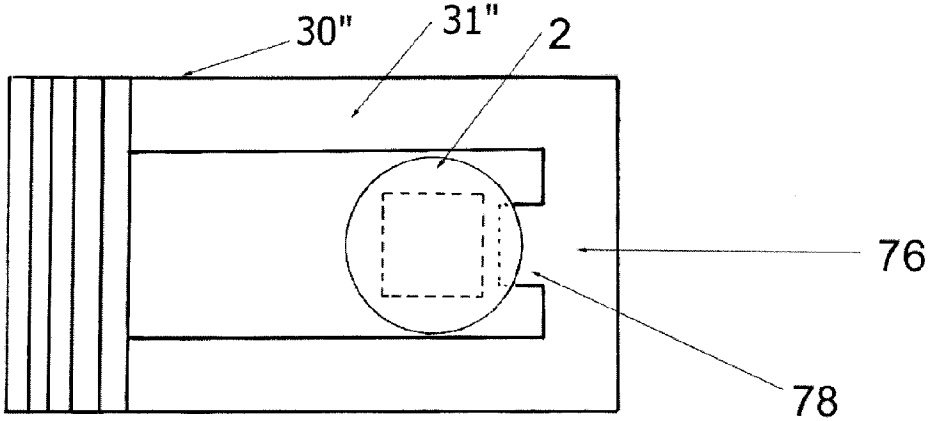
FIG. 6*b* is a top view of a locking piece according to another embodiment of the present invention.

FIGS. 6*a* and 6*b* are top views of a locking piece according to other embodiments of the present invention. FIG. 6*a* shows a top view of a locking piece 30' without recesses on the two legs 31' and the distance between the two legs is equal to or larger than the diameter of upper portion 2*a* of push button 2 (if the upper portion 2*a* is in a cylindrical shape or a disk shape as shown in FIG. 1), or equal to or larger than the traverse dimension of upper portion 2*a* of push button 2 (if the upper portion 2*a* is not in a disk or cylindrical shape). There provided extrusion pieces 72 and 74 at the end of the legs 31', respectively. When assembled, extrusion pieces 72 and 74 extend into passage 101 through an opening (not shown) on sidewall 100*b* so as to partially block passage 101 and prevent push button 2 from being pressed down. Similarly, FIG. 6*b* shows a top view of a locking piece 30" without recesses on the two legs 31" and the two legs are closed at end 76. There provided an extrusion piece 78 at the closed end 76 of the two legs 31". When assembled, extrusion piece 78 extrudes into the passage 101 through an opening (not shown) on sidewall 100*b* so as to block passage 101 and prevent push button 2 from being pressed down.

The above described locking piece 30 and slide base 1 are exemplary. Various modifications can be made according the teachings of the present invention. For example, recess 32 may form on only one leg 31. Slide base 1 may be made in one piece or a combination of multiple pieces with same or different material.

FIGS. 3*a* through 3*d* demonstrate an operation procedure of the gas-fired ignition device of the present invention. FIG. 3*a* shows the initial position of the safety control ignition switch. At this initial position, push button 2 is locked, i.e., it cannot be pushed down, and slide base 1 cannot be moved forward either. To operate the gas-fired ignition device, one has to pull back locking piece 30 against slide base 1 as shown in FIG. 3*b*. At this position, recesses 32 on legs 31 of locking piece 30 is aligned with through hole 11*a* in upper portion 1*a* of slide base 1, so that push button 2 can be pushed down with upper portion 2*a* being pushed into the passage defined by side wall 100 and recesses 32. As shown in FIG. 3*c*, this downward movement of push button 2 brings conductive contact plate 20 into contact with contacts 5 and 5'to produce sparks. This movement also releases or disengages stop rod 210 of brake block 21 from track 3, which is originally inserted into track 3 to block forward movement of slide base 1. When stop rod 210 is disengaged with track 3, slide base 1 is free to move forward. As shown in FIG. 3*d*, while push button 2 is pushed down, slide base 1 is moved forward to pull nozzle 4 to release the fuel gas from fuel tank 25 and to make a flame. After push button 2 is released and moved upward due to the elastic force of compression spring 22, locking piece 30 automatically returns to the initial position due to the elastic force of compression spring 36. In the process, stop rod 210 moves upward with push button 2 and inserts back into the space between slide base 1 and track 3. The smoothly curved upper portion 211 with gradually reduced dimension upwards helps the insertion which forces slice base 1 to return to its original position. Therefore, when the gas-fired ignition device is not in use, locking piece 30 is always kept in a locking position. The above whole operation can be done by one hand. Further, the size and structure of handling block 34 of locking piece 30, upper portion 1*a* of slide base 1, and push button 2 can be made such that all the operational movements, i.e., pulling back locking piece 30, pushing down push button 2 while keeping locking piece 30 in an unlocking position, and moving slide base 1 forward while keeping push button 2 down, can be handled easily by an adult's thumb, but difficult for a child to complete the above operation procedure.

The present invention also provides a valve handle 42. As shown in FIG. 4, valve handle 42 comprises a handle 44 and an oval-shaped adjusting head 46. A portion 46*a* of the oval-shaped adjusting head 46 has an inner diameter conforming to the outer diameter of a disk-shaped valve 40 of fuel tank 25 and, at this portion, the inner sidewall of oval-shaped adjusting head 46 has a plurality of teeth 48. On the surface of the sidewall of disk-shaped valve 40, there are also provided a plurality of teeth 52 running in the axial direction of disk-shaped vale 40 for engaging with teeth 48. A spring plate 60 is mounted on oval-shaped adjusting head 46, dividing oval-shaped adjusting head 46 into two portions. When assembled, disk-shaped valve 40 is inserted between portion 46*a* and spring plate 60. As shown in FIG. 5*a*, spring plate 60 forces disk-shaped valve 40 against portion 46*a* so that teeth 48 engage with teeth 52 and disk-shaped valve can be adjusted by turning handle 44. In this way, the volume of the gas flow from fuel tank 25 is adjusted. On the other hand, if teeth 48 on portion 46*a* become disengaged with teeth 52 on disk-shaped valve 40, for example, by pushing handle 44 toward disk-shaped valve 40 as shown in FIG. 5*b*, turning handle 44 will be no longer able to adjust disk-shaped valve 40. The advantage of such a valve handle is that the position of handle 44 at maximum flame mark on the ignition device and the corresponding maximum volume flow from fuel tank 25 can be adjusted from outside after the ignition device is assembled. Clearly, adjusting head 46 is not limited to an oval-shape. Many other suitable shapes of adjusting head 46 are also applicable. There are slits 62 provided on adjusting head 46 for receiving and holding spring plate 60. In the embodiment shown in FIG. 4, there are three slits 62, two of them are substantially perpendicular to the central longitudinal axis of turning handle 44 and located on the two opposite sides of the central longitudinal axis of turning handle 44. The third slit 62 is located beside one of the above two slits 62 and forms an angle θ therewith. The spring plate 60 may have a hook with an angle ϕ, which is slightly larger than θ, in one end and, when spring plate 60 is inserted into slits 62, the hook portion of spring plate 60 fits into the third slit 62. The spring force of the hook on spring plate 60 prevents the spring plate 60 from moving at the perpendicular and horizontal directions to the central longitudinal axis of turning handle 44 so that guarantees the spring plate 60 in its position after installation.

The present invention has been described using exemplary embodiments. However, it is to be understood that the scope of the present invention is not limited to the disclosed embodiments. On the contrary, it is intended to cover various modifications and similar arrangement or equivalents. The scope of the claims, therefore, should be accorded the broadest interpretation so as to encompass all such modifications and similar arrangements and equivalents.

What is claimed is:

1. A safety control switch for a gas-fired ignition device comprising:

a slide base movably mounted in a track of a housing of the gas-fired ignition device which triggers release of ignitable fuel once in slided position;

a push button positioned in a through hole of the slide base, in a depressed state creates a spark by completing an electrical circuit, to ignite released fuel;

a brake block fixed to the push button configured for inserting into the track to fill a space between the slide base and the track; and a locking piece movably mounted on the slide base and engaged with the through hole of the slide base, the locking piece is arranged so as to be moved relative to the slide base between a first position to prevent the push button and the slide base from being operated wherein a portion of said locking piece is located to prevent the push button from passing through the through hole and a second position to allow the push button and the slide base to be operated by removing the blockage of the through hole;

wherein the locking piece is returned to first position through the force exerted by a tension loaded mechanism when there is no external force acting thereon.

2. The safety control switch of claim 1, wherein the slide base comprises an upper body and a lower body separated by a middle portion, an extrusion edge is formed along two edges on a lower surface of the upper body, the locking piece comprises two legs and each leg has a grove along its upper outer edge, when assembled, the two legs are inserted onto the middle portion of the slide base and the extrusion edge engages with the grove so as to prevent the two legs from moving away from each other.

3. The safety control switch of claim 1, wherein the locking piece comprises two legs with a recess, when the locking piece is moved to the second position, the recess aligns with the through hole which forms an unobstructed passage for the push button to be pressed down so as to electrically connect an ignition circuit of the gas-fired ignition device to produce sparks and, at the same time, to disengage the brake block from the track.

4. The safety control switch of claim 3, wherein the through hole of the slide base comprises an upper portion, a middle portion, and a lower portion, the two legs of the locking piece partially extrude into the through hole at the middle portion and partially block the through hole when the recess is not aligned with the through hole.

5. The safety control switch of claim 3, wherein each of the two legs has an inward-directed hook at an open end.

6. The safety control switch of claim 3, wherein the locking piece comprises handling block connected to the two legs, the handling block has a hole for receiving one end of a compression spring, a recess is formed on the slide base for receiving the other end of the compression spring.

7. The safety control switch of claim 6, wherein the handling block has an inclined and grooved upper surface.

8. The safety control switch of claim 1, wherein the locking piece comprises two legs with an extrusion piece at the end of the legs, when the locking piece is moved to the second position, the extrusion piece disengages with the through hole allowing the push button to be pressed down so as to electrically connect an ignition circuit of the gas-fired ignition device to produce sparks and, at the same time, to disengage the brake block from the track.

9. The safety control switch of claim 1, wherein the slide base comprises an upper body and a lower body separated by a middle portion, the locking piece comprises two legs and a handling block connected to the two legs and, when assembled, the two legs are inserted onto the middle portion of the slide base and the handling block of the locking piece is adjacent to the upper body of the slide base.

10. A method of operating a safety control switch for a gas-fired ignition device comprising:

providing a gas-fired ignition device with a safety control switch, wherein the safety control switch comprises a slide base mounted on a housing of the gas-fired ignition device; a push button positioned in a through hole of the slide base; and a locking piece mounted on the slide base and moved relative to the slide base between a first position to prevent the push button and the slide base from being operated and a second position to allow the push button and the slide base to be operated in a continous motion;

pulling back the locking piece to move it to the second position;

while holding the locking piece at the second position, pressing down the push button to produce sparks; and while pressing down the push button, moving the slide base forward to release fuel gas to make a flame;

wherein the locking piece automatically returns to the first position when external force acting thereon the safety control switch is released.

* * * * *